US009712928B2

(12) United States Patent
Pedersen et al.

(10) Patent No.: US 9,712,928 B2
(45) Date of Patent: Jul. 18, 2017

(54) BINAURAL HEARING SYSTEM

(71) Applicant: Oticon A/S, Smørum (DK)

(72) Inventors: Michael Syskind Pedersen, Smørum (DK); Jan Mark De Haan, Smørum (DK); Pauli Minnaar, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 15/010,670

(22) Filed: Jan. 29, 2016

(65) Prior Publication Data

US 2016/0227332 A1 Aug. 4, 2016

(30) Foreign Application Priority Data

Jan. 30, 2015 (EP) ..... 15153253

(51) Int. Cl.
*H04R 25/00* (2006.01)
*H04R 1/10* (2006.01)

(52) U.S. Cl.
CPC ..... *H04R 25/552* (2013.01); *H04R 25/558* (2013.01); *H04R 1/1083* (2013.01); *H04R 2225/41* (2013.01); *H04R 2225/43* (2013.01); *H04R 2225/61* (2013.01)

(58) Field of Classification Search
None
See application file for complete search history.

(56) References Cited

U.S. PATENT DOCUMENTS 8,737,653 B2 * 5/2014 Woods ..... H04R 25/552 381/23.1
8,768,478 B1 7/2014 James
9,014,406 B2 * 4/2015 Thomsen ..... H04R 25/552 381/317
2006/0109994 A1 5/2006 Husung et al.
2010/0111338 A1 5/2010 Ypma et al.
2010/0135500 A1 * 6/2010 Derleth ..... H04R 25/552 381/23.1
2012/0128164 A1 * 5/2012 Blamey ..... H04R 5/04 381/28
2015/0245129 A1 * 8/2015 Dusan ..... H04R 1/1083 381/71.6

FOREIGN PATENT DOCUMENTS

WO WO 2006/105664 A1 10/2006
WO WO 2010/022456A-1 3/2010

* cited by examiner

*Primary Examiner* — Paul Huber
(74) *Attorney, Agent, or Firm* — Birch, Stewart, Kolasch & Birch, LLP

(57) ABSTRACT

A binaural hearing system comprising left and right hearing devices is provided, each comprising an input unit providing an electric input signal representing an environmental sound; a noise reduction system for estimating and reducing a noise component of the electric input signal; antenna and transceiver circuitry allowing the exchange of data between the hearing devices. The binaural hearing system is—in a mode of operation, where a sound source is predominantly audible at a first one of the hearing devices—configured to transmit the estimate of the noise component determined in a second one of the hearing devices to the first hearing device and to use said estimate to reduce the noise component in the electric signal of the first hearing device and to provide a noise reduced signal in the first hearing device. Thereby improved noise reduction is provided for use, e.g. in hearing aids, in non-symmetric acoustic situations.

18 Claims, 6 Drawing Sheets

BINAURAL HEARING SYSTEM

TECHNICAL FIELD

The present application relates to noise reduction in a binaural hearing system, e.g. in a binaural hearing aid system. The disclosure relates specifically to binaural noise reduction in an asymmetric acoustic near-field environment.

Embodiments of the disclosure may e.g. be useful in applications such as hearing aids, headsets, ear phones, active ear protection systems and combinations thereof.

BACKGROUND

The present disclosure deals in particular with noise reduction in a binaural hearing system in an asymmetric near-field environment, such as is e.g. present when a person engages in a telephone conversation, where a target sound is only audible on one ear, but the background noise is present at both ears. For a hearing impaired person wearing a hearing instrument at one or both ears, this situation is particularly challenging, but also provides possible options for improving the intelligibility of the target signal by appropriate signal processing of the signals received and/or picked up by the respective hearing instrument(s).

WO2006105664A1 deals with binaural hearing instrument systems comprising left and right hearing instruments including binaural processing circuits that generate left and right audio output signals, respectively, as a function of the signal-to-noise ratios (SNRs) of both the left and right audio input signals.

US2010111338A1 deals with a method of adjusting a signal processing parameter for a first hearing aid and a second hearing aid forming parts of a binaural hearing aid system to be worn by a user. The binaural hearing aid system comprises a user specific model representing a desired asymmetry between a first ear and a second ear of the user, e.g. defined by a discrete 'synchronization mode' variable, that controls the 'overall amount of asymmetry' in the binaural hearing aid system. As an example, a 'high' value of the synchronization mode variable will constrain the steering parameters to be very similar, whereas 'medium' and 'low' values will allow more deviations and finally 'off' will not synchronize the adjustments among the ears. The latter may e.g. be beneficial when picking up the phone (where the binaural hearing aid system should e.g. behave in an asynchronous mode).

SUMMARY

The present disclosure proposes to use a noise estimate determined in one of the hearing instruments of a binaural hearing system to reduce the noise in the other hearing instrument, in the case where a near-field sound source is only (or predominantly) audible at the other hearing instrument (such situation being identified automatically or manually and defining a specific near-field mode of operation of the binaural hearing system). It is proposed to use a noise estimate form the hearing instrument not being subject to a near-field sound source (assuming the noise conditions on both instruments are similar). In other words, it is an objective to improve the near-field sound based on the noise estimate on the opposite side, because the noise is easier to estimate in the absence of the near field sound. The signal containing the near-field sound has a higher SNR compared to the signal (at the opposite ear) in absence of a near field source. So it is proposed to use the estimate of the noise signal from the side containing the poorest SNR. The noise component is thus used to further improve the SNR on the side containing the near field sound.

An object of the present application is to provide an improved binaural hearing system.

Objects of the application are achieved by the invention described in the accompanying claims and as described in the following.

A Binaural Hearing System:

In an aspect of the present application, an object of the application is achieved by a binaural hearing system comprising left and right hearing devices adapted for being located at or in left and right ears of a user, or adapted for being fully or partially implanted in the head of the user, each of the left and right hearing devices comprising

- an input unit for providing an electric input signal representing a sound in the environment of the hearing device;
- a noise reduction system for estimating and reducing a noise component of the electric input signal;
- antenna and transceiver circuitry allowing an interaural wireless communication link between the left and right hearing devices to be established to allow exchange of data between them, wherein the binaural hearing system—in a specific near-field mode of operation, where a near-field sound source is present (e.g. detected) at a first one of the left and right hearing devices—is configured to transmit the estimate of the noise component, or a measure thereof, determined in a second one of the hearing devices of the binaural hearing system to the first hearing device and to use said estimate to reduce the noise component in the electric signal of the first hearing device and to provide a noise reduced signal in the first hearing device.

This has the advantage of providing an improved noise reduction in a non-symmetric acoustic situation. The noise estimate to be used in the binaural hearing system is measured at the ear having the lowest signal to noise ratio (in a specific mode of operation, where a near field sound source has been detected at one of the ears). In an embodiment, noise component estimated in the hearing device where no near field sound source has been detected is transmitted to the hearing device where a near field sound source has been detected and either used directly at the noise component or combined with the locally estimated noise component.

In the specific near-field mode of operation, a near-field sound source is present in the environment of the hearing system. The presence of a near-field sound source may e.g. be detected by the binaural hearing system by an environment detector (e.g. comprising one or more level detectors). In an embodiment, a near-field sound source is present at a first one of the left and right hearing devices. In an embodiment, a near-field sound source is predominantly audible at a first one of the left and right hearing devices.

Preferably, the binaural hearing system is configured to extract or receive information about, (e.g. whether—and if yes—) which of the left and right hearing devices currently receives sound from a near-field sound source (e.g. based on a detection and comparison of input levels of received signals at the left and right hearing devices). In an embodiment, information about which of the left and right hearing devices currently receives sound from the near-filed sound source is included in the specific near-field mode of operation. In an embodiment, the binaural hearing system is configured to allow data related to the control of the respective noise reduction systems (e.g. including data related to a direction to or a location of a target sound source) to be exchanged between the hearing devices. In an embodiment, the interaural wireless communication link is based on near-field (e.g. inductive) communication. Alternatively, the interaural wireless communication link is based on far-field (e.g. radiated fields) communication, e.g. according to Bluetooth or Bluetooth Low Energy or similar standard or proprietary scheme.

In an embodiment, each of the left and right hearing devices—at least when in said specific near-field mode of operation—is configured to generate or provide a noise-reduced signal based fully or partially on one or both of the respective noise estimates from the left and right hearing devices.

In an embodiment, at least one (such as each) of the left and right hearing devices comprises an output unit for presenting a processed signal as stimuli perceived by the user as sound. In an embodiment, the output unit comprises a number of electrodes of a cochlear implant. In an embodiment, the output unit comprises an output transducer. In an embodiment, the output transducer comprises a receiver (loudspeaker) for providing the stimuli as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the binaural hearing system comprises a user interface configured to communicate with the left and right hearing assistance devices to allow a user to influence functionality of the left and right hearing assistance devices. In an embodiment, the binaural hearing system is configured to allow the user to control a mode of operation of the binaural hearing system via the user interface. In an embodiment, the setting of a mode of operation of the binaural hearing system to the specific near-field mode of operation includes information about which of the left and right hearing devices currently receives sound from the near-field sound source.

In an embodiment, at least one of the left and right hearing devices comprises an activation element forming part of the user interface. In an embodiment, the binaural hearing system comprises an auxiliary device configured to fully or partially implement the user interface. In an embodiment, the auxiliary device is or comprises a remote control of the hearing assistance system. In an embodiment, the auxiliary device comprise a portable communication device. In an embodiment, the portable communication device comprises a cellular telephone, a smartwatch, glasses comprising a computer, a tablet computer, a personal computer, a laptop computer, a notebook computer, phablet, etc., or any combination thereof, wherein the user interface is implemented. In an embodiment, a display and activation elements of the auxiliary device (e.g. a SmartPhone) form part of the user interface. In an embodiment, the user interface is fully or partially implemented via an APP running on the auxiliary device and an interactive display (e.g. a touch sensitive display) of the auxiliary device (e.g. a SmartPhone).

In an embodiment, the binaural hearing system is configured to provide that the specific near-field mode of operation of the binaural hearing system is automatically entered based on inputs from one or more detectors. In an embodiment, the one or more detectors comprises a level detector, a voice detector, an own voice detector, and a proximity detector.

In an embodiment, the noise reduction system of the (e.g. second) hearing device for which a near-field sound source is NOT detected is configured to provide that the noise estimate that is transmitted to the first hearing device is the magnitude response of the noise signal measured in different frequency channels. In an embodiment, the magnitude response is low-pass filtered.

In an embodiment, the binaural hearing system is configured to—when in said specific near-field mode of operation—limit the noise estimate that is determined in the second hearing device and used in the first hearing device to frequencies below a low-frequency threshold $f_{LF,th}$. In an embodiment, the binaural hearing system—when in said specific near-field mode of operation—the noise reduction system of the second hearing device is configured to limit the noise estimate that is transmitted to the first hearing device to frequencies below a low-frequency threshold $f_{LF,th}$. In an embodiment, the low-frequency threshold $f_{LF,th}$ is smaller than or equal to 3.5 kHz (which is the approximate bandwidth of a telephone signal), such as smaller than or equal to 2.0 kHz, such as smaller than or equal to 1.5 kHz.

In an embodiment, the first hearing device—when in said specific near-field mode of operation—is configured to combine the received noise estimate from the second hearing device with the noise estimate of its own noise reduction system. In an embodiment, the first hearing device—when in said specific near-field mode of operation—is configured to use the received noise estimate only at the lower frequencies, e.g. below the low-frequency threshold $f_{LF,th}$.

In an embodiment, the hearing system is configured to exchange an estimate of the signal-to-noise ratio as estimated in the respective hearing devices between the left and right hearing devices.

In an embodiment, the binaural hearing system is configured to present the noise-reduced signal or a signal derived therefrom in each of the left and right hearing devices via the respective output units.

In an embodiment, the binaural hearing system is configured to provide that the electric input signal of the first hearing device—when in said specific near-field mode of operation—comprising a mixture of the near-field signal and a background noise is transmitted to the second hearing device. Thereby a similar processing is applied, and an enhanced version of the telephone signal is presented to the user through the output units of the left and right hearing devices.

In an embodiment, the binaural hearing system is configured to exchange one or more of said electric input signal(s) representing a sound in the environment of the respective hearing devices, or signals derived therefrom. The electric input signals are e.g. exchanged via the interaural wireless communication link. The electric input signals e.g. may be in the time domain or in the time-frequency domain.

In an embodiment, the near-field signal is generated by a sound source at that is substantially louder at one of the user's ears than at the other. In an embodiment, the near-field signal is generated by a loudspeaker of a portable device, e.g. when held close to one of the user's ears.

In an embodiment, each of the left and right hearing devices are adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, each of the hearing devices comprises a signal processing unit for enhancing an input signal and providing a processed output signal.

In an embodiment, the input unit comprises an input transducer for converting an input sound to an electric input signal. In an embodiment, each of the hearing devices comprises a multitude (e.g. two or more) of input transducers, e.g. microphones. In an embodiment, each of the hearing devices comprises a directional microphone system (here also termed a beamformer unit) adapted to enhance a target acoustic source among a multitude of acoustic sources in the local environment of the user wearing the hearing device/system. In an embodiment, the directional system is adapted to detect (such as adaptively detect) from which direction a particular part of the microphone signal originates. This can be achieved in various different ways as e.g. described in the prior art.

In an embodiment, the noise reduction system comprises a beamforming part, e.g. configured to focus on a target speech signal and/or a single channel noise reduction unit configured to apply a time-varying gain to the incoming audio signal.

In an embodiment, each of hearing devices comprises a multi-input noise reduction system comprising a multi-channel beamformer filtering unit operationally coupled to said multitude of inputs, and configured to provide a beamformed signal. Preferably, the beamformers (multi-channel beamformer filtering units) are designed to deliver a gain of 0 dB for signals originating from a given direction/distance, while suppressing signal components originating from any other spatial location. Alternatively, the beamformers are designed to deliver a larger gain (smaller attenuation) for signals originating from a given (target) direction/distance data, than signal components originating from any other spatial location. In an embodiment, the beamformers of the left and right hearing devices are configured to apply the same gain (or attenuation) to signal components from the target signal source (so that any spatial cues in the target signal are not obscured by the beamformers). In an embodiment, the multi-channel beamformer filtering unit of each of the left and right hearing devices comprises a linearly constrained minimum variance (LCMV) beamformer. In an embodiment, the beamformers are implemented as minimum variance distortionless response (MVDR) beamformers.

In an embodiment, each of said left and right hearing devices comprises a single channel post-processing filter unit operationally coupled to the multi-channel beamformer filtering unit and configured to provide an enhanced signal. An aim of the single channel post filtering process is to suppress noise components from the target direction (which has not been suppressed by the spatial filtering process, e.g. an MVDR beamforming process). It is a further aim to suppress noise components during time periods where the target signal is present or dominant (as e.g. determined by a voice activity detector) as well as when the target signal is absent. In an embodiment, the single channel post filtering process is based on an estimate of a target signal to noise ratio for each time-frequency tile (m,k). In an embodiment, the estimate of the target signal to noise ratio for each time-frequency tile (m,k) is determined from the beamformed signal and the target-cancelled signal. The enhanced signal thus represents a spatially filtered (beamformed) and noise reduced version of the current input signals (noise and target).

The binaural hearing system is adapted to allow an interaural wireless communication link between the left and right hearing devices to be established to allow exchange of data between them. In an embodiment, the system is configured to allow data related to the control of the respective multi-microphone noise reduction systems (e.g. including data related to the estimate of the noise component, or a measure thereof) to be exchanged between the hearing devices. In an embodiment, the interaural wireless communication link is based on near-field (e.g. inductive) communication. Alternatively, the interaural wireless communication link is based on far-field (e.g. radiated fields) communication e.g. according to Bluetooth or Bluetooth Low Energy or similar standard.

In an embodiment, the binaural hearing assistance system is adapted to allow an external wireless communication link between an auxiliary device and the respective left and right hearing assistance devices to be established to allow exchange of data between them. In an embodiment, the system is configured to allow transmission of data related to the current mode of operation of the hearing system, to each (or one) of the left and right hearing assistance devices. In an embodiment, the external wireless communication link is based on near-field (e.g. inductive) communication. Alternatively, the external wireless communication link is based on far-field (e.g. radiated fields) communication e.g. according to Bluetooth or Bluetooth Low Energy or similar standard or proprietary scheme.

In an embodiment, the binaural hearing assistance system is adapted to allow an external wireless communication link to an auxiliary device (e.g. based on radiated fields) as well as an interaural wireless link (e.g. based on near-field communication) to be established. This has the advantage of improving reliability and flexibility of the communication between the auxiliary device and the left and right hearing assistance devices.

In an embodiment, the hearing devices have a maximum outer dimension of the order of 0.15 m, such as of the order of 0.08 m, such as of the order of 0.04 m.

In an embodiment, each of the hearing devices are a portable device, each device comprising a local energy source, e.g. a battery, e.g. a rechargeable battery.

In an embodiment, each of the hearing devices comprises a forward or signal path between an input unit and an output unit. In an embodiment, the signal processing unit is located in the forward path. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, each of the hearing device, e.g. the input unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit-comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of frequency bands, where NI is e.g. larger than 5, such as larger than 10, such as larger than 50, such as larger than 100, such as larger than 500, at least some of which are processed individually.

In an embodiment, one or both of the hearing devices comprises a level detector (LD) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment.

In a particular embodiment, one or both of the hearing devices comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, one or both of the hearing devices comprises an own voice detector for detecting whether a given input sound (e.g. a voice) originates from the voice of the user of the system. In an embodiment, the microphone system of the hearing device is adapted to be able to differentiate between a user's own voice and another person's voice and possibly from NON-voice sounds.

In an embodiment, the binaural hearing system comprises an (acoustic) environment detector. In an embodiment, the environment detector is configured to detect whether or not a sound source is a near-field sound source relative to one of the user's ears (i.e. to the left and right hearing devices). In an embodiment, the environment detector comprises one or more detectors, e.g. including a level detector. In an embodiment, each of the first and second hearing devices comprises a level detector. In an embodiment, the binaural hearing system is adapted to exchange control signals from one or more detectors located in the respective hearing devices. In an embodiment, the binaural hearing system is configured to compare values of control signals picked up in the left and right hearing devices and to thereby identify a near-field sound source with respect to any one of the left and right hearing devices.

In an embodiment, the specific near-field mode of operation of the binaural hearing system is automatically entered based on inputs from one or more detectors, e.g. one or more of the level detector, voice detector and own voice detector. In an embodiment, one of or each of the hearing devices comprises a proximity detector for indication whether an audio delivery device (e.g. a telephone) is in close vicinity (e.g. within a predefined distance, e.g. less than 0.1 m) of the hearing device. In an embodiment, the audio delivery device comprises a magnet that can be detected in a hearing device by a magnetic field sensor. Thereby the specific near-field mode of operation of the binaural hearing system can be automatically entered based on inputs from the proximity sensor.

In an embodiment, the hearing device further comprises other relevant functionality for the application in question, e.g. feedback suppression, compression, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a binaural hearing system as described above, in the 'detailed description of embodiments' and in the claims, is moreover provided. In an embodiment, use is provided in a system comprising one or more hearing instruments, headsets, ear phones, active ear protection systems, etc., e.g. in handsfree telephone systems, teleconferencing systems, public address systems, karaoke systems, classroom amplification systems, etc. In an embodiment, use of the binaural hearing system with a telephone (to improve the intelligibility of speech received via the telephone) is provided. In an embodiment, use of the binaural hearing system in a car or other vehicle, e.g. an air-plane.

A Method:

In an aspect, a method of operating a binaural hearing system comprising left and right hearing devices adapted for being located at or in left and right ears of a user, or adapted for being fully or partially implanted in the head of the user is furthermore provided by the present application. The method comprises

- providing an electric input signal representing a sound in the environment of the hearing device;
- estimating and reducing a noise component of the electric input signal;
- providing an interaural wireless communication link between the left and right hearing devices to be established to allow exchange of data between them; and
- when in a specific near-field mode of operation, where a near-field sound source is present (e.g. detected) at a first one of the left and right hearing devices—transmitting the estimate of the noise component, or a measure thereof, determined in a second one of the hearing devices of the binaural hearing system to the first hearing device; and
- using said estimate to reduce the noise component in the electric signal of the first hearing device; and
- providing a noise reduced signal in the first hearing device.

It is intended that some or all of the structural features of the system described above, in the 'detailed description of embodiments' or in the claims can be combined with embodiments of the method, when appropriately substituted by a corresponding process and vice versa. Embodiments of the method have the same advantages as the corresponding system.

In an embodiment, the method comprises: using the estimate of the noise component, or a measure thereof, from the (second) hearing device being subject to the poorest signal to noise ratio to improve the signal to noise ratio in the (first) side hearing device being exposed to the near field sound source.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

DEFINITIONS

The 'near-field' of an acoustic source is typically taken as a region close to the source where the sound pressure and acoustic particle velocity are not in phase (wave fronts are, not parallel). In the near-field, acoustic intensity can vary greatly with distance (compared to the far-field). The near-field is generally taken to be limited to a distance from the source equal to about a wavelength of sound. The wavelength A of sound is given by $\lambda=c/f$, where c is the speed of sound in air (343 m/s, @ 20° C.) and f is frequency. At f=1 kHz, e.g., the wavelength of sound is 0.343 m (i.e. 34 cm). In the acoustic 'far-field', on the other hand, wave fronts are parallel and the sound field intensity decreases by 6 dB each time the distance from the source is doubled (inverse square law).

The term 'near-field sound source' is in the present context e.g. taken to mean that the sound source is located at a distance to a first one of the hearing devices (located at a first ear of the user) that is significantly smaller (e.g. more than 25% smaller, such as more than 50% smaller than the distance to the second one of the hearing devices (located at the second ear of the user). In an embodiment, the term 'near-field sound source' is taken to mean that the sound source is within 1 m of a side of the user's head (ear), where the first hearing device is located, such as within 0.5 m, such as within 0.2 m or 0.1 m from the first hearing device. Preferably the head (and body) of the user is located between the near-field sound source and the second hearing device (so that the user's head/body attenuates the near-field sound source at the second hearing device). A near-field sound source may e.g. be defined by it being audible at one ear but not (or substantially less) at the other ear of the user. Preferably, sound from the near-field sound source when received by the second hearing device is attenuated more than 40 dB, such as more than 60 dB compared to sound from the near-field sound source when received by the first hearing device. In other words, a 'near-field sound source' can be defined by its position relative to the user's first and second ears AND to its distance from the user. A 'near-field sound source' (relative to a specific user) may thus be defined as a sound source, which is closer to (and/or more audible at) one ear than the other AND which is within a maximum distance of the user.

In the present context, the term 'beamforming' ('beamformer') is taken to mean (provide) a 'spatial filtering' of a number of inputs sensor signals with the aim of attenuating signal components from certain angles relative to signal components from other angles in a resulting beamformed signal. 'Beamforming' is taken to include the formation of linear combinations of a number of sensor input signals (e.g. microphone signals), e.g. on a time-frequency unit basis, e.g. in a predefined or dynamic/adaptive procedure.

In the present context, a 'hearing device' refers to a device, such as e.g. a hearing aid or hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing devices, an amplifier may constitute the signal processing circuit. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' may refer to a system comprising one or two hearing devices, and a 'binaural hearing system' refers to a system comprising one or two hearing devices and being adapted to cooperatively provide audible signals to both of the user's ears. Hearing systems or binaural hearing systems may further comprise 'auxiliary devices', which communicate with the hearing devices and affect and/or benefit from the function of the hearing devices. Auxiliary devices may be e.g. remote controls, audio gateway devices, mobile phones, public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1:
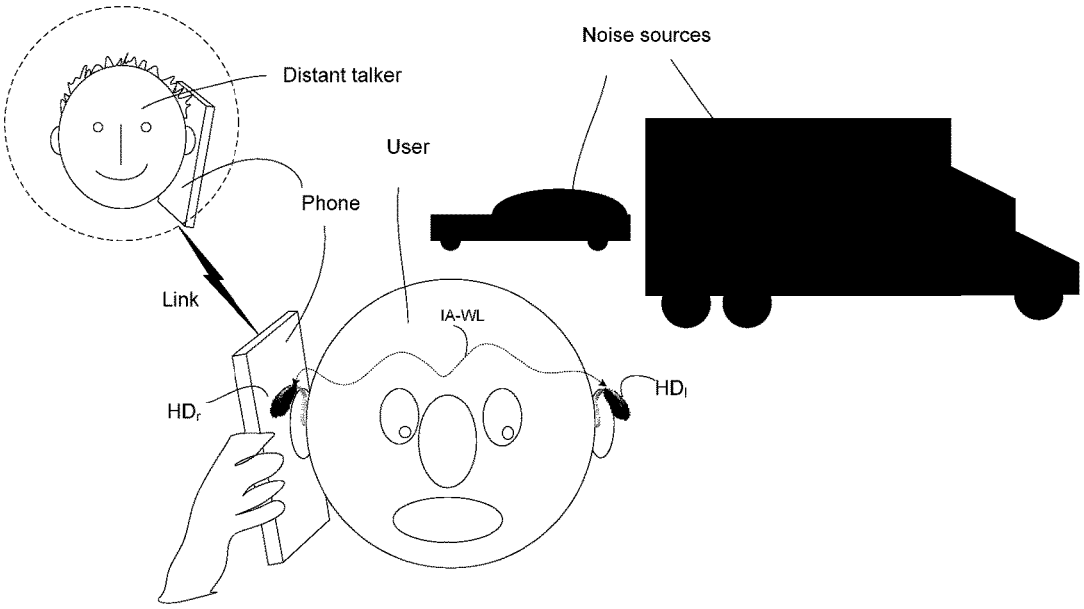
FIG. 1 illustrates a scenario, where a person wearing a binaural hearing system is engaged in a telephone conversation in a noisy environment.

FIG. 1 shows a scenario, where a person wearing a binaural hearing system is engaged in a telephone conversation in a noisy environment. FIG. 1 shows a situation, where a person (User) wearing hearing instruments ($HD_l$, $HD_r$) at left and right ears tries to hear a distant talker (Distant talker) through a telephone (Phone) and a corresponding telephone line (Link) connecting the telephones (e.g. a public switched telephone network, PSTN, and/or the Internet). The speech understanding becomes difficult because background sound (Noise sources) (here illustrated by traffic noise from cars; but it could be any sound source other than the target signal) is also being picked up by the hearing instruments. Because the telephone is very close (e.g. within 0.2 m) to one of the hearing instruments (here $HD_r$), the telephone signal is (substantially) only picked up by that one of the hearing instruments ($HD_r$). The background noise will, however, be picked up by both hearing instruments ($HD_l$, $HD_r$), and we thus have a situation where the other hearing instrument (here $HD_l$) can provide a good estimate of the noise (e.g. noise variance). This estimate (determined in $HD_l$) may be transmitted via an interaural wireless link (IA-WL) and applied to the input signal in the hearing instrument ($HD_r$) close to the telephone (Phone) in order to reduce the background noise and hereby enhance the intelligibility of the telephone signal. A description of an embodiment of the proposed method is shown in FIG. 2.

Figure 2:
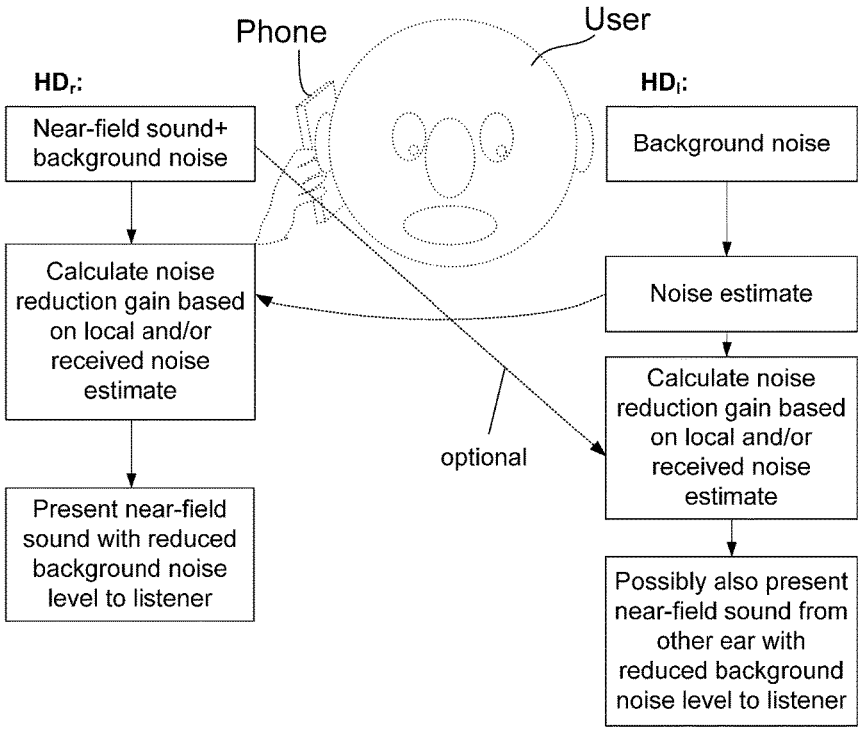
FIG. 2 shows a flow diagram of possible implementations of a method according to the present disclosure.

FIG. 2 shows a flow diagram of possible implementations of a method according to the present disclosure. Assuming that it is known at which ear (hearing instrument, $HD_l$, $HD_r$) the target sound is the closest (the right ear/instrument $HD_r$ in FIGS. 1 and 2), the background noise or noise variance may be determined at the other ear (the left ear/hearing instrument HD, in FIGS. 1 and 2). The estimated noise or noise variance from the other ear (at $HD_l$) is transmitted (cf. curved dotted arrow in FIG. 2) to the hearing instrument ($HD_r$) with the near-field sound source (Phone in FIG. 2) and used to reduce the background noise in a signal of the forward path (of $HD_r$). Especially at lower frequencies, where the head shadow effect is insignificant, the noise or noise variance estimate at the other ear ($HD_l$) may represent the noise or noise variance at the ear ($HD_r$), which is the closest to the near-field sound source (here the telephone, Phone). Hereby the hearing instrument (HQ) will be able to attenuate the background noise and thus enhance the intelligibility of the near-field sound source. In some frequency bands, the noise or noise variance may be estimated based on the local signal only or as a (e.g. weighted) combination of the two estimates (one from each hearing instrument, $HD_l$, $HD_r$), each being e.g. dominating in selected (e.g. complementary) frequency ranges.

In an embodiment, the received noise or noise variance estimate from the other ear (at $HD_l$) is only used in the lower frequencies. The lower frequencies may e.g. be defined as frequencies up to 1000 Hz, such as up to 1500 Hz, or up to 2000 Hz or up to 3500 Hz, the latter being the approximate bandwidth of a telephone signal.

In an embodiment, the enhanced (noise-reduced) signal is presented to the listener (User) (e.g. the noise reduced telephone signal at the right ear and the noise reduced 'noise only' signal at the left ear).

In an embodiment, the recorded mixture of the near-field signal and background noise (at $HD_r$) is transmitted to the other hearing device (at $HD_l$) (cf. straight line dotted arrow in FIG. 2 denoted optional) in order to apply a similar processing, and hereby present an enhanced version of the telephone signal through both hearing devices.

Figure 3:
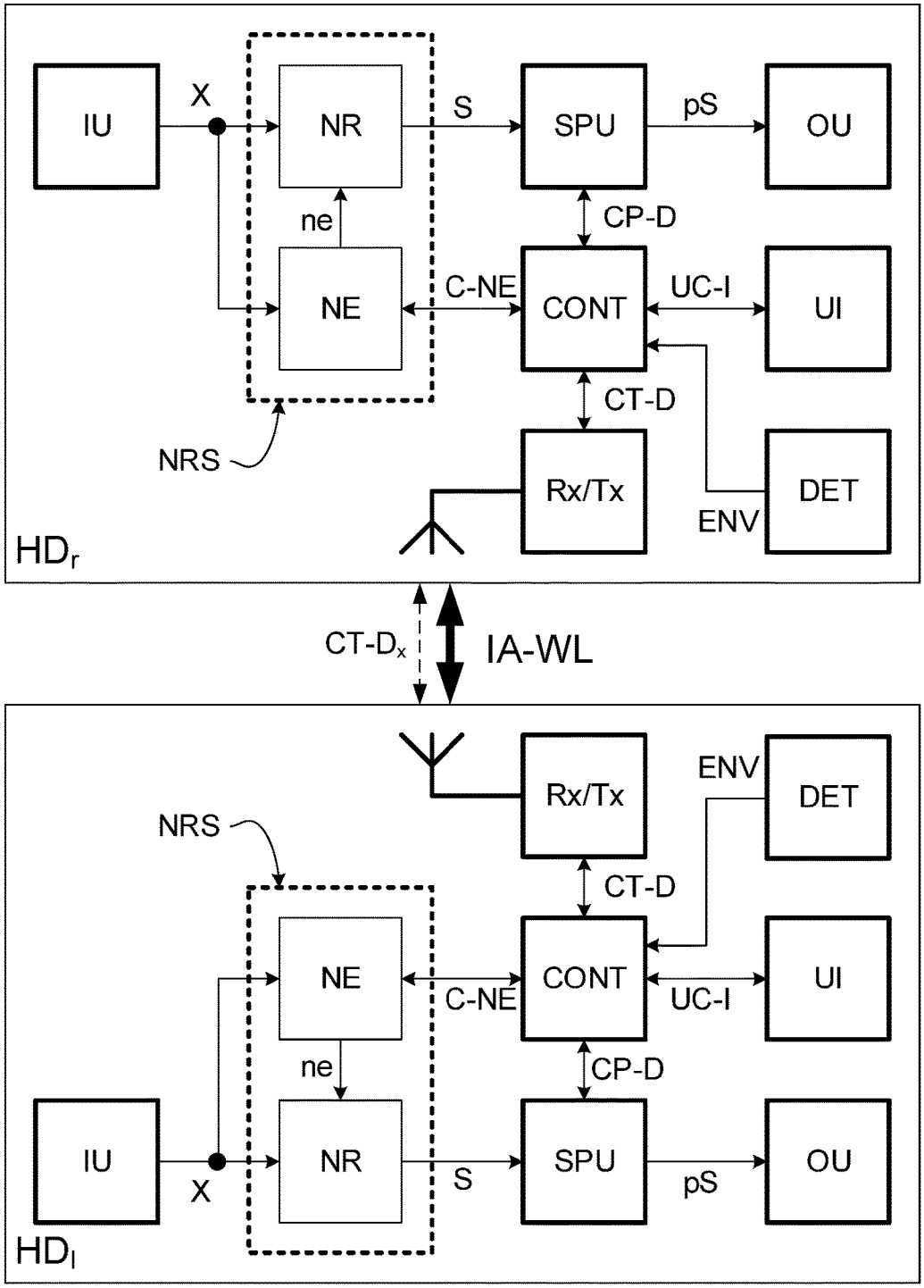
FIG. 3 shows a first embodiment of a binaural hearing system according to the present disclosure.

FIG. 3 shows a first embodiment of a binaural hearing system according to the present disclosure. FIG. 3 shows a binaural hearing system comprising left and right hearing devices ($HD_l$, $HD_r$) adapted for being located at or in left and right ears of a user, or adapted for being fully or partially implanted in the head of the user. Each of the left and right hearing devices comprises an input unit (IU) for providing an electric input signal X representing a (typically time-variant) sound in the environment of the hearing device. The input unit (IU) is operationally connected to a noise reduction system (NRS) (dashed outline in FIG. 3) for estimating and reducing a noise component of the electric input signal X, and providing a noise reduced signal S. Each of the left and right hearing devices ($HD_l$, $HD_r$) further comprises a control unit (CONT) for controlling the noise reduction system (NRS) via signal C-NE. The control unit (CONT) is in operational connection with antenna and transceiver circuitry (Rx/Tx) allowing an interaural wireless communication link (IA-WL) between the left (HD) and right ($HD_r$) hearing devices to be established to allow exchange of data CT-$D_x$ between them (including a noise estimate ne and possibly audio data). In a specific near-field mode of operation, a near-field sound source (e.g. a loudspeaker of a telephone apparatus, cf. e.g. FIG. 1) is predominantly audible at a first one of the left and right hearing devices (e.g. the right, $HD_r$, as in FIG. 1). In this mode, the binaural hearing system is configured to transmit the estimate of the noise component (e.g. comprised in signal ne), or a measure thereof (e.g. generated in control unit (CONT)), as determined in a second one (e.g. the left, $HD_l$) of the hearing devices of the binaural hearing system to the opposite (first) hearing device (e.g. the right, $HD_r$). The estimate of the noise component (ne) in the second hearing device (e.g. the left, $HD_l$), or a measure thereof, is used to reduce the noise component in the electric signal X of the first hearing device (e.g. the right, HD) and to provide a noise reduced signal S in the first hearing device. The electric input signal of the first hearing device comprising a mixture of the near-field signal and a background noise is e.g. transmitted to the second hearing device (at least when the system is in the specific near-field mode of operation) via the interaural wireless link (IA-WL, signal CT-$D_R$)). Hence, the electric input signal of the first hearing device can be used in the second hearing device and processed according to the settings of the second hearing device, so that an enhanced version of the telephone signal is presented to the user at both ears through output units (OU) of the respective left and right hearing devices. Alternatively, the electrical signals picked up or received by the input units of the respective first and second hearing devices are processed and presented in their device of origin, e.g. based on the noise estimate of the second hearing device (or on a combination of the noise estimates of the first and second hearing devices).

Each of the left and right hearing devices ($HD_l$, $HD_l$) of the binaural hearing system comprises an acoustic environment detector (DET) configured to detect whether or not a sound source is a near-field sound source relative to the respective left and right hearing devices. The environment detector (DET) may comprise a single or a multitude of detectors, preferably including a level detector (e.g. adapted to work in on a frequency band level). The control signal(s) ENV from the environment detector (DET) is(are) fed to the control unit (CONT). The binaural hearing system is adapted to exchange control signals ENV between the respective hearing devices (via control unit (CONT) and the interaural link (IA-WL)). The respective control units (CONT) are configured to compare values of control signals picked up in the left and right hearing devices and to thereby identify a near-field sound source with respect to any one of the left and right hearing devices.

Each of the left and right hearing devices further comprises a user interface (UI) to allow a user to influence functionality of the left and right hearing assistance devices, including to allow the user to control a mode of operation of the binaural hearing system (via signal UC-I between the user interface and the control unit (CONT)). The hearing system is preferably configured to allow data from the hearing devices (e.g. representing status information) to be presented to a user via the user interface (UI, and signal UC-I). Each of the left and right hearing devices further comprises a signal processing unit (SPU), e.g. for further processing a noise reduced signal S from the noise reduction system (NRS) (e.g. to apply a level and/or frequency dependent gain according to the needs of the user) and providing a processed signal pS. The processed signal pS is fed to an output unit (OU, e.g. a loudspeaker, a vibrator, or an electrode array) for presenting stimuli to be perceived by a user as sound. The noise reduction system (NRS) comprises e.g. a noise estimation unit (NE) for providing a noise estimate (e.g. a noise variance estimate, signal ne) and a noise reduction unit (NR) for attenuating noise components of the input signal X according to the noise estimate ne thereby providing noise reduced signal S. The control unit (CONT) is preferably configured to control or influence the various functions in the respective hearing devices, including the noise estimation unit (NE, via signal C-NE) and the resulting noise estimate (ne) applied to the input signal X by the noise reduction unit (NR), the transceiver circuitry (Rx/Tx, via signal CT-D), the user interface (UI, via signal UC-I), and the signal processing unit (SPU, via signal CP-D).

The interaural wireless communication link is preferably based on near-field (e.g. inductive) communication, e.g. in a frequency range below 100 MHz, e.g. below 10 MHz. Alternatively, the interaural wireless communication link is based on far-field (e.g. radiated fields) communication e.g. according to Bluetooth or Bluetooth Low Energy or similar standard or proprietary scheme, e.g. in a frequency range above 100 MHz, e.g. around 2.4 GHz, such as 5.8 GHz.

Figure 4A:
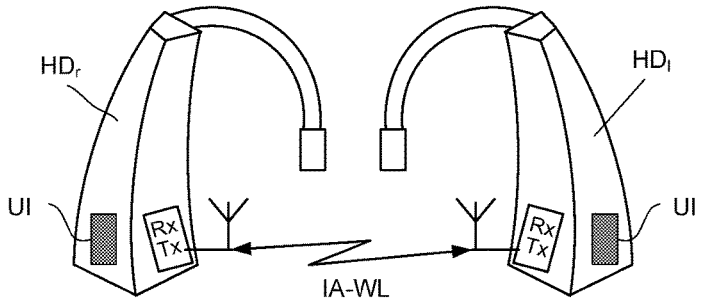
FIGS. 4A and 4B illustrate a second embodiment of a binaural hearing system according to the present disclosure, FIG. 4A illustrating exemplary left and right hearing assistance devices, and FIG. 4B showing corresponding exemplary block diagrams.
Figure 4B:
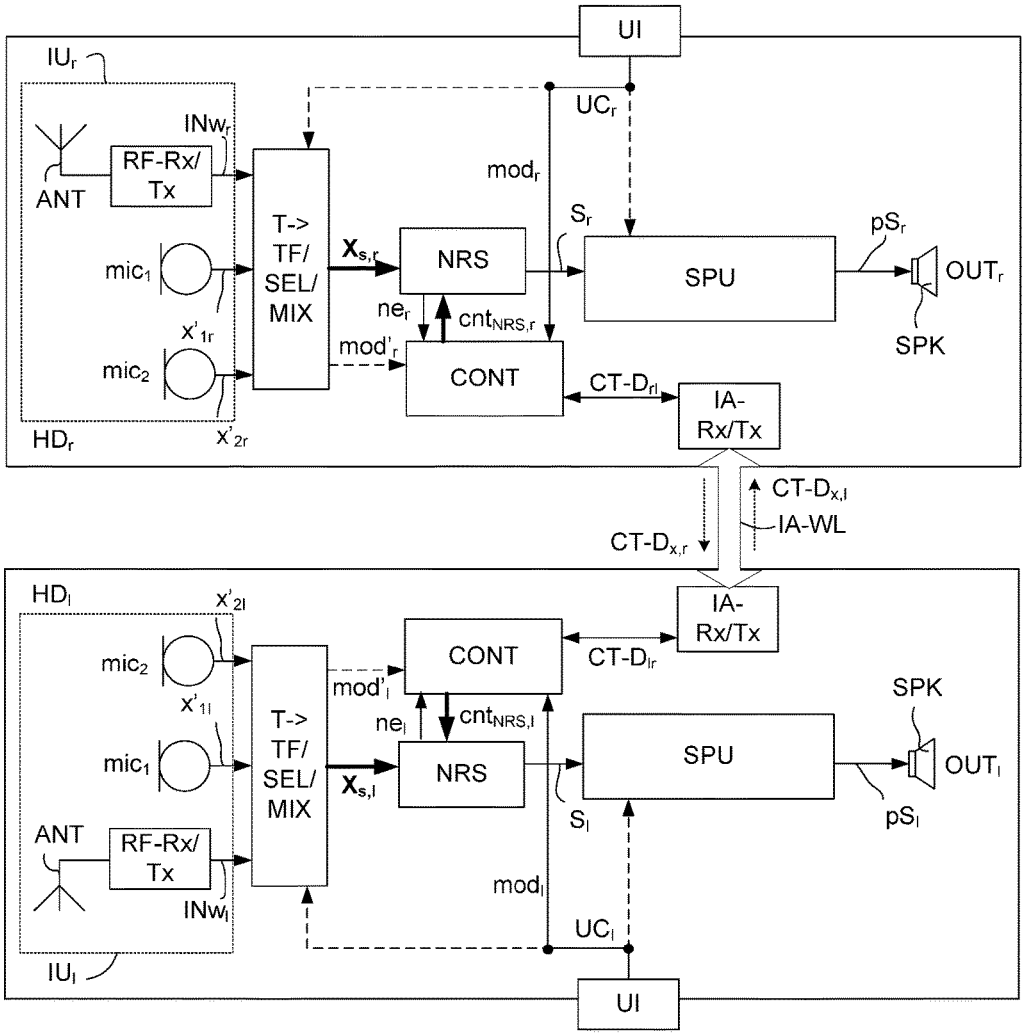

FIG. 4A shows an example of a binaural hearing system comprising first and second hearing assistance devices $HD_l$, $HD_r$. The hearing devices are adapted to exchange information via wireless link IA-WL implemented by respective antennas and transceivers RxTx. The information that can be exchanged between the two hearing assistance devices comprises noise estimates and optionally audio signals (e.g. one or more (e.g. all) frequency bands of one or more audio signals). The first and second hearing devices $HD_l$, $HD_r$ of FIG. 4A are shown as BTE-type devices, each comprising a housing adapted for being located behind an ear (pinna) of a user, the hearing devices each comprising an input unit, e.g. comprising one or more input transducers, e.g. microphones ($mic_1$, $mic_2$), a signal processing unit (SPU) and an output unit (SPK) (e.g. an output transducer, e.g. a loudspeaker), cf. FIG. 4B. In the embodiment of FIGS. 4A and 4B, each of the left and right hearing devices comprises an activation element constituting or forming part of the user interface UI. The user interface UI is adapted to allow a user to influence functionality (including a mode of operation) of the left and right hearing assistance devices. In an embodiment, all of these components are located in (or on) the housing of the BTE-part. In such case, the sound from the output transducer may be propagated to the ear canal of the user via a tube connected to a loudspeaker outlet of the BTE-part. The tube may be connected to an ear mould specifically adapted to the form of the users' ear canal and allowing sound signals from the loudspeaker to reach the ear drum of the ear in question. Alternatively, the output transducer may be located separately from the BTE-part, e.g. in the ear canal of the user or in concha, and electrically connected to the signal processing unit of the BTE-part (e.g. via electric conductors or a wireless link).

FIG. 4B shows exemplary block diagrams of an embodiment of a binaural hearing system, e.g. a binaural hearing aid system, comprising left and right hearing devices ($HD_l$, $HD_r$), e.g. as shown in FIG. 4A. The left and right hearing devices are adapted for being located at or in left and right ears of a user. Alternatively, the left and right hearing devices may be adapted for being fully or partially implanted in the head of the user (e.g. to implement a bone vibrating (e.g. bone anchored) hearing device for mechanically vibrating bones in the head of the user, or to implement a cochlear implant type hearing device comprising electrodes for electrically stimulating the cochlear nerve in the left and right sides of the user's head). The hearing devices are adapted for exchanging information between them via a wireless communication link, here via a specific inter-aural (IA) wireless link (IA-WL) implemented by corresponding antenna and transceiver circuitry (IA-Rx/Tx) of the left and right hearing devices, respectively. The two hearing devices ($HD_l$, $HD_r$) are e.g. adapted to allow the exchange of control signals and audio data signals CT-$D_x$ including noise estimates ($ne_r$, $ne_l$, respectively) of corresponding electric input signals between the two hearing devices, cf. dotted arrows indicating a transfer of signals CT-$D_{x,r}$ from the right to the left hearing device and signals CT-$D_{x,l}$ from the left to the right hearing device. Each hearing device ($HD_l$, $HD_r$) comprises a forward signal path comprising input units ($IU_l$, $IU_r$, e.g. comprising microphones ($mic_1$, $mic_e$) and/or wired or wireless receivers (ANT, RF-Rx/Tx)) operatively connected to a signal processing unit (SPU) and one or more output units (here loudspeaker (SPK)). Between the input units ($mic_1$, $mic_2$) and the signal processing unit (SPU), and in operative connection with both, a time to time-frequency conversion unit (T→TF) and a multi-channel noise reduction system (NRS) are located. The time to time-frequency conversion unit (T→TF) provides time-frequency representations $X_i(k,m)$ ($X_{s,r}$ and $X_{s,l}$ in FIG. 4B) of (time variant) input signals $x'_i$ ($x'_{il}$, $x'_{ir}$, respectively) at the $i^{th}$ input unit, i=1, 2, (outputs of $mic_1$, $mic_2$) in a number of frequency bands k and a number of time instances m. The time-frequency representation $X_i(k,m)$ of the $i^{th}$ input signal is assumed to comprise a target signal component and a noise signal component, the target signal component originating from a target signal source $S_s$. (e.g. an acoustic near-field sound source, e.g. a telephone located at one of the left and right hearing devices). The time to time-frequency conversion unit (T→TF) is in the embodiment of FIG. 4B integrated with a selection/mixing unit (SEL/MIX) for selecting the input units currently to be connected to the multi-channel noise reduction system (NRS). Different input units may e.g. be selected in different modes of operation of the binaural hearing assistance system.

In the embodiment of FIG. 4B, each hearing device ($HD_l$, $HD_r$) further comprises antenna and transceiver circuitry (ANT, RF-Rx/Tx) for receiving data from an auxiliary device (cf. e.g. AD in FIG. 6), e.g. a mode selection input ($mod'_l$, $mod'_r$), the auxiliary device e.g. comprising the user interface (or an alternative or supplementary user interface) for the binaural hearing assistance system. Alternatively or additionally, the antenna and transceiver circuitry (ANT, RF-Rx/Tx) may be configured to receive an audio signal comprising an audio signal from another device, e.g. from a microphone located separately from the main part of the hearing assistance device in question (but e.g. at or near the same ear). Such received signal INw may (e.g. in a specific mode of operation, e.g. controlled via signal UC from the user interface UI) be one of the input audio signals to the multi-channel noise reduction system (NRS). Each of the left and right hearing devices ($HD_l$, $HD_r$) comprises a control unit (CONT) for controlling the multi-channel noise reduction system (NRS) via signals $cnt_{NRS,l}$ and $cnt_{NRS,r}$. The control signals $cnt_{NRS}$ may e.g. include noise estimation information ($ne_l$, $ne_r$) regarding the currently present audio source(s) as received from the local noise reduction system of a hearing device and/or from the opposite hearing device via the interaural link IA-WL.

Figure 5:
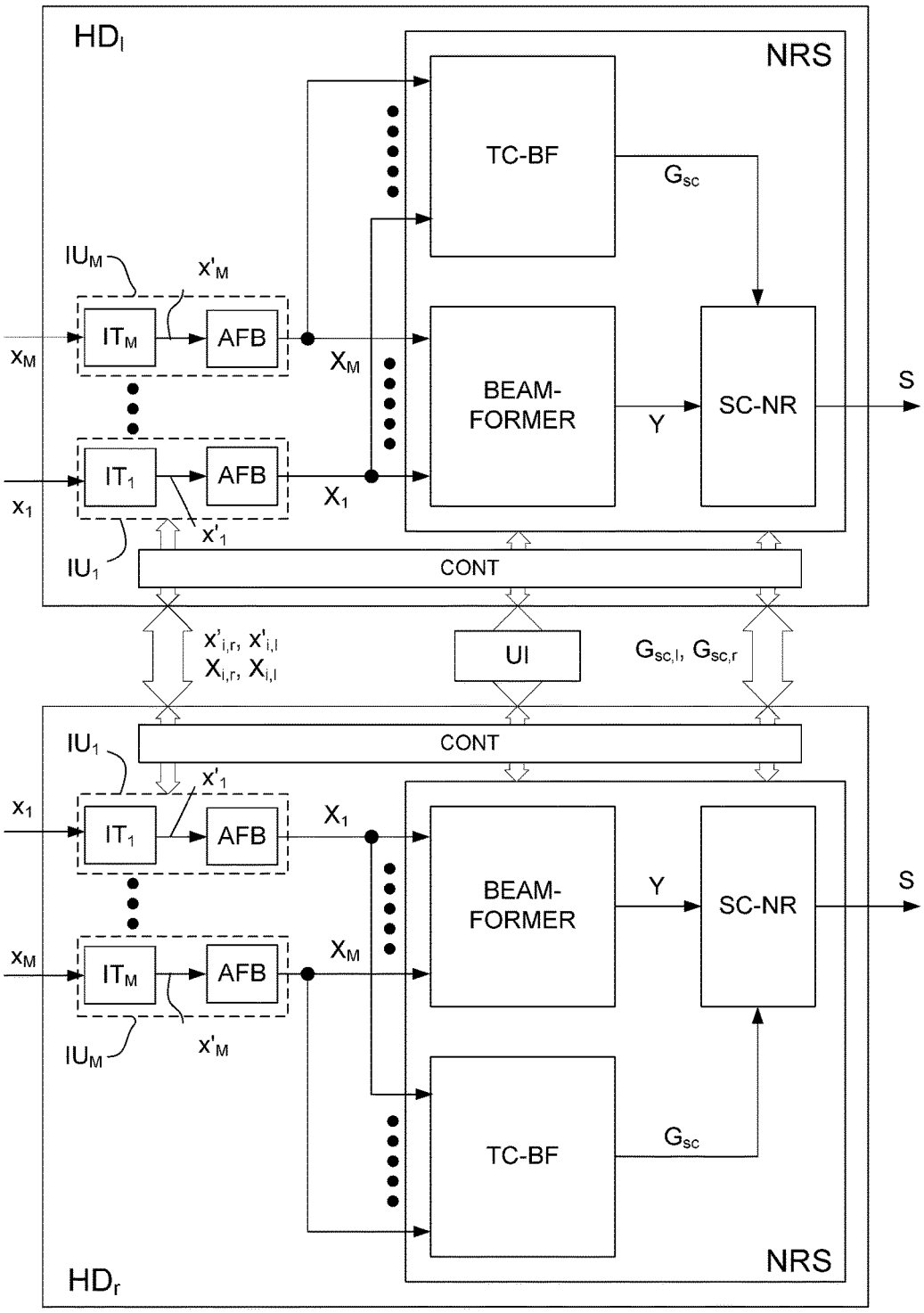
FIG. 5 shows a third embodiment of a binaural hearing system according to the present disclosure.

The respective multi-channel noise reduction systems (NRS) of the left and right hearing devices is e.g. embodied as shown in FIG. 5. The multi-channel noise reduction systems (NRS) provides an enhanced (beamformed and noise reduced) signal S ($S_l$, $S_r$, respectively). The respective signal processing units (SPU) receive the enhanced input signal and provides a further processed output signal pS ($pS_l$, $pS_r$, respectively), which is fed to the output transducer (SPK) for being presented to the user as an audible signal OUT ($OUT_l$, $OUT_r$, respectively). The signal processing unit (SPU) may apply further algorithms to the input signal, e.g. including applying a level and/or frequency dependent gain for compensating for a user's particular hearing impairment. In an embodiment, the system is adapted so that (in addition to or as an alternative to activation elements (UI in FIG. 4A) on the left and right hearing devices), a user interface of an auxiliary device (AD in FIG. 6) allows a user (U) to indicate a mode of operation of the hearing system (via the wireless receiver (ANT, RF-Rx/Tx) and signal INw, providing mode control signals mod', and $mod'_r$, respectively, (dashed arrows in FIG. 4B) between the selection or mixing unit (SEL/MIX) and the control unit (CONT) of the respective hearing devices).

The control and/or audio data signals $CT\text{-}D_{x,r}$ and $CT\text{-}D_{x,l}$ are received and extracted by the respective antenna and transceiver circuitries (IA-Rx/Tx) and forwarded to the respective control units (CONT) of the opposite hearing device as signals $CT\text{-}D_{l,r}$ and $CT\text{-}D_{r,l}$, in the left and right hearing devices, respectively. The signals $CT\text{-}D_{l,r}$ and $CT\text{-}D_{r,}$, comprise information allowing a control (e.g. a synchronized or individual operation) of the multi-channel noise reduction systems (NRS) of the left and right hearing devices (and may e.g. comprise source localization data, mode control data, gains of respective single-channel noise reduction systems, sensor signals, e.g. from respective voice activity detectors, audio data signals, etc.). A locally (e.g. in $HD_l$) determined noise estimate (e.g. $ne_l$) or a noise estimate (e.g. $ne_r$) determined in the opposite hearing device (e.g. $HD_r$) can be used in a given hearing device to update the respective noise reduction systems (NRS) controlled by the control unit (CONT). Alternatively, a (e.g. weighted) combination of the respective data (e.g. noise estimates $ne_l$, $ne_r$) from the local and the opposite hearing device can be used together to update the respective multi-channel noise reduction systems (NRS) controlled by the control unit (CONT), and to thereby optimize the resulting signal(s) of the forward path in the left and right hearing devices. In an embodiment, a low frequency part of the noise estimate from the opposite hearing device (not being close to the near-field audio source) is used in combination with a locally determined noise estimate to update the (e.g. multi-channel) noise reduction system (NRS) of the hearing device being close to the near-field audio source. In the embodiment of FIG. 4B, each hearing device comprises a user interface (UI) allowing a user to control functionality of the respective hearing device, and/or of the binaural hearing system system (cf. dashed and solid signal paths $UC_l$, respectively). The manually operable and/or a remotely operable user interface(s) (UI) (generating a control signals $UC_r$ and $UC_l$, respectively) may e.g. provide user inputs to one or more or the signal processing unit (SPU), the control unit (CONT), the selector and mixer unit (T→TF-SEL-MIX) and the (e.g. multi-channel) noise reduction system (NRS). Preferably, the user interfaces (UI) allow a user to indicate a mode of operation of the hearing system (device), including a specific near-field mode of operation.

FIG. 5 shows a third embodiment of a binaural hearing system according to the present disclosure.

FIG. 5 shows an embodiment of a binaural hearing assistance system comprising left ($HD_l$) and right ($HD_r$) hearing assistance devices according to the present disclosure. Compared to the embodiments of FIG. 3 an 4B, the input units IU of the embodiment of FIG. 5 are detailed out in separate input units ($IU_1, \ldots, IU_M$) in each of the left and right hearing devices, respectively. Each input unit $IU_i$ comprises an input transducer or receiver $IT_i$ for transforming a sound signal x, to an electric input signal x', or for (wired or wirelessly) receiving an electric input signal representing a sound signal. Each input unit $IU_i$ further comprises a time to time-frequency transformation unit, e.g. an analysis filterbank (AFB), for splitting the electric input signal ($x'_i$) into a number of frequency bands (k) providing signal $X_i$ (i=1, 2, . . . , M). Further, the multi-input unit noise reduction systems (NRS) of the left and right hearing assistance devices each comprises a multi-channel beamformer filtering unit (BEAMFORMER, e.g. an MVDR beamformer) providing beamformed signal Y and additionally a single-channel post-processing filter unit (SC-NR) providing enhanced (beamformed and noise reduced) signal S. The single-channel post-processing filter unit (SC-NR) is operationally coupled to the multi-channel beamformer filtering unit (BEAMFORMER) and configured to provide an enhanced signal S(k,m), where k and m are frequency and time indices, respectively. A purpose of the single-channel post-processing filter unit (SC-NR) is to suppress noise components from the target direction, which have not been suppressed by the multi-channel beamformer filtering unit (BEAMFORMER).

A task of the single-channel post-processing filter unit (SC-NR) is to suppress noise components during time periods, where the target signal is present or dominant (as e.g. determined by a voice activity detector, VAD, e.g. forming part of the control unit CONT, as well as when the target signal is absent. Preferably, the VAD-control signals (e.g. binary voice, no-voice, or soft, probability based dominant, non-dominant) are defined for each time-frequency tile (m,k). In an embodiment, the single-channel post filtering process is based on an estimate of a target signal to noise ratio for each time-frequency tile (m,k). Such SNR estimates may e.g. be based on the size of the modulation (e.g. a modulation index) in the respective beamformed signals Y(k,m).

In the embodiment of FIG. 5, the respective noise reduction systems (NRS) of the left and right hearing devices ($HD_l$, $HD_r$) each additionally comprises a target-cancelling beamformer TC-BF receiving inputs signals $X_1$, $X_M$ and providing gains $G_{sc}$ to be applied to respective time-frequency units of the beamformed signal Y in the respective single-channel post-processing filter units (SC-NR) as illustrated in FIG. 5.

The embodiment of FIG. 5 provides an optional exchange of (one or more) electric input unit (time domain) signals $x'_{i,l}$ and $x'_{i,r}$ and/or the (one or more) electric input unit (time-frequency domain) signals $X'_{i,l}$ andf $X_{i,r}$ (i=1, 2, . . . , M) between the two hearing assistance devices, as indicated by the left arrow between the two devices (cf. leftmost wide arrows between the respective control units (CONT) of the left and right hearing devices). Preferably, the estimate of the target signal to noise ratio for each time-frequency tile (m,k) of the resulting signal S from the noise reduction system, NRS, (here from the SC-NR unit) is determined from the beamformed signal Y and the target-cancelled signal (cf. gains $G_{sc}$ in FIG. 5). The SC-NR systems of the left and right hearing devices may exchange their estimates of their (time-frequency dependent) gain values (as indicated in FIG. 5 by the noise estimates (gains) $G_{sc,l}$, $G_{sc,r}$ at the rightmost wide arrows between the respective control units (CONT) of the left and right hearing devices). The control unit(s) may be configured to use the same gain value, for example the largest of the two gain values, for a particular time-frequency unit. In this way, the suppression applied to a certain time-frequency unit is the same in the two ears, and no artificial inter-aural level differences are introduced. The control unit(s) may further be configured to use the noise estimates (gains ($G_{sc}$)) from one hearing device in a selected frequency range and to use the noise estimates (gains ($G_{sc}$)) from the other hearing device in another (e.g. complementary) frequency range. The embodiment of a binaural hearing system shown in FIG. 5 comprises a user interface (UI) for allowing a user to influence the function of the hearing system (cf. middle wide arrow between the left and right hearing devices via user interface UI), e.g. for setting the system in a specific mode of operation, e.g. the specific near-field mode of operation, is indicated between the two hearing aid devices. The user interface (e.g. implemented in a remote control device, e.g. a SmartPhone) may include or consist of sensors for extracting information about the current target sound source from the user (e.g. providing information about a currently relevant look vector of the beamformer). The hearing devices ($HD_l$, $HD_r$) may further comprise a memory (e.g. embodied in respective control units CONT) for storing a database comprising a number of predefined look vectors and/or beamformer weights each corresponding to the beamformer pointing in and/or focusing at a number of predefined directions and/or locations. In an embodiment, the user provides information about target direction of and distance to the target signal source via the user interface (UI).

Figure 6A:
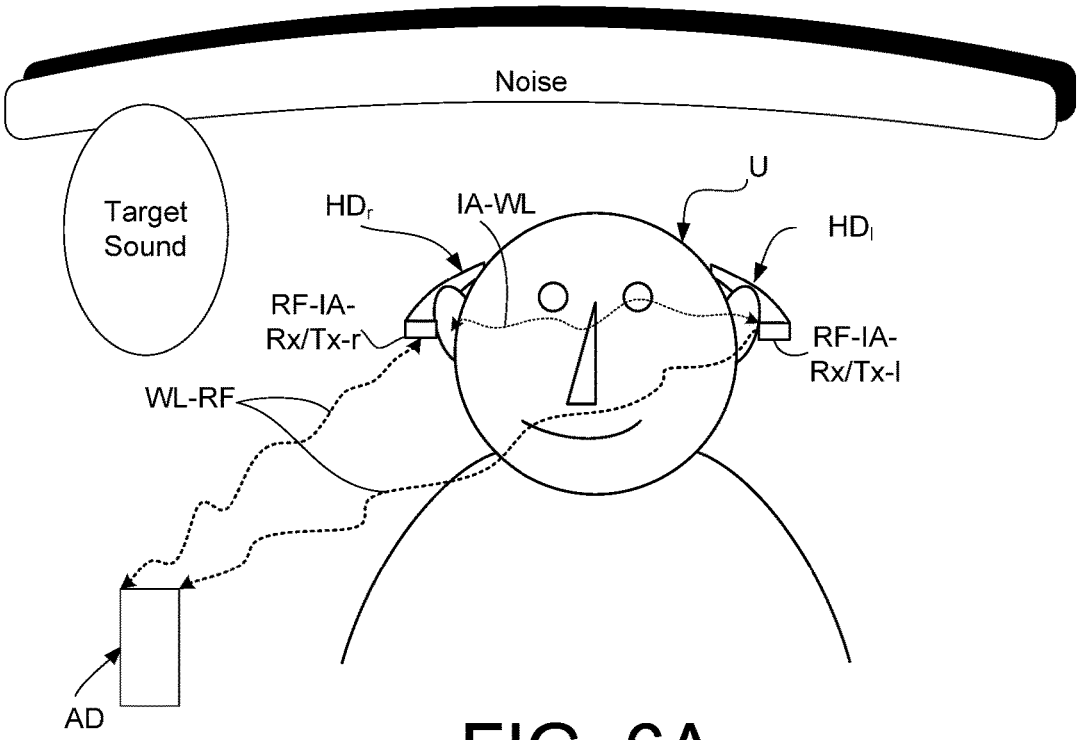
FIGS. 6A and 6B illustrate a fourth embodiment of a binaural hearing aid system comprising left and right hearing devices in communication with an auxiliary device (FIG. 6A), the auxiliary device functioning as a user interface (FIG. 6B) for the binaural hearing aid system.

FIG. 6A shows an embodiment of a binaural hearing system comprising left (second) and right (first) hearing devices ($HD_l$, $HD_r$) in communication with a portable (handheld) auxiliary device (AD) functioning as a user interface (UI) for the binaural hearing aid system. In an embodiment, the binaural hearing system comprises the auxiliary device (AD, and the user interface UI). In the embodiment of FIG. 6A, wireless links denoted IA-WL (e.g. an inductive link between the left and right hearing devices) and WL-RF (e.g. RF-links (e.g. Bluetooth) between the auxiliary device AD and the left $HD_l$, and between the auxiliary device AD and the right $HD_r$, hearing device, respectively) are indicated (implemented in the devices by corresponding antenna and transceiver circuitry, indicated in FIG. 6A in the left and right hearing devices as RF-IA-Rx/Tx-I and RF-IA-Rx/Tx-r, respectively). In the acoustic situation illustrated by FIG. 6A a dominant sound source, denoted Target Sound, is located to the right of the user (U) and a more distributed noise sound field, denoted Noise, is indicated around the user.

Figure 6B:
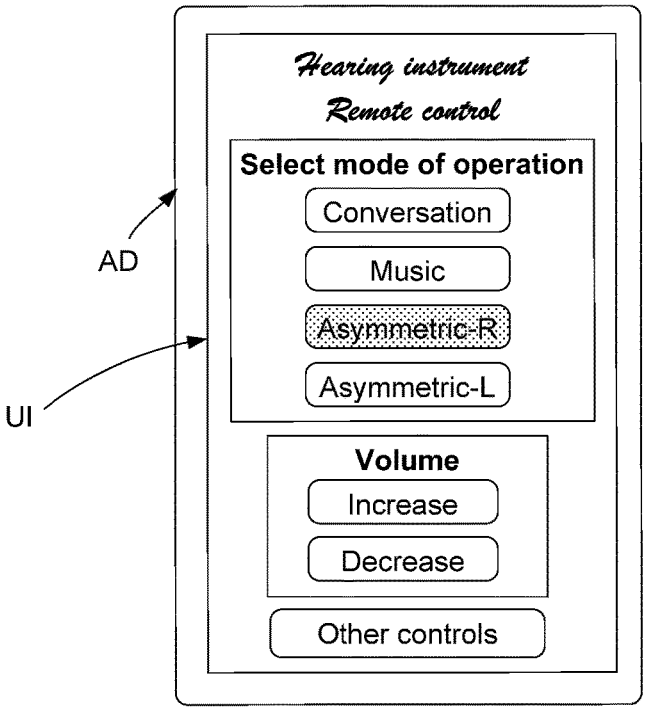

The user interface (UI) of the auxiliary device (AD) is shown in FIG. 6B. The user interface comprises a display (e.g. a touch sensitive display) displaying a screen of a Hearing Instrument Remote Control APP for controlling the hearing system and a number of predefined actions regarding functionality of the binaural hearing system. In the exemplified (part of the) APP, a user (U) has the option of influencing a mode of operation via the selection of one of a number of predefined acoustic situations (in box Select mode of operation). The exemplary acoustic situations are: Conversation, Music, Asymmetric-R, and Asymmetric-L, each illustrated as an activation element, which is selected one at a time by clicking on the element. Each exemplary acoustic situation is associated with the activation of specific algorithms and specific processing parameters (programs) of the left and right hearing devices.

In the example of FIG. 6B, the acoustic situation Asymmetric-R has been chosen, (as indicated by the dotted shading of the corresponding activation element on the screen). The acoustic situation Asymmetric-R refers to a specific near-field mode of operation of the hearing system, where a dominant sound source is located to the right of the user (as indicated in FIG. 6A by the element Target Sound). In the exemplified remote control APP-screen of FIG. 6B, the user further has the option of modifying volume of signals played by the hearing devices to the user (cf. box Volume). The user has the option of increasing and decreasing volume (cf. corresponding elements Increase, and Decrease), e.g. both hearing devices simultaneously and equally, or, alternatively, individually (this option being e.g. available to the user by clicking on element Other controls in the bottom of the exemplary screen of the remote control APP).

The auxiliary device AD comprising the user interface UI is adapted for being held in a hand of a user (U), and hence convenient for displaying a current location of a target sound source.

The wireless communication link(s) (WL-RF, IA-WL in FIG. 6A) between the hearing devices and the auxiliary device and between the left and right hearing devices may be based on any appropriate technology with a view to the necessary bandwidth and available part of the frequency spectrum. In an embodiment, the wireless communication link (WL-RF) between the hearing devices and the auxiliary device is based on far-field (e.g. radiated fields) communication e.g. according to Bluetooth or Bluetooth Low Energy or similar standard or proprietary scheme. In an embodiment, the wireless communication link (IA-WL) and between the left and right hearing devices is based on near-field (e.g. inductive) communication.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

WO2006105664A1 (Gennum) 12.10.2006
US2010111338A1 (GN Resound) 06.05.2010

The invention claimed is:

1. A binaural hearing system comprising left and right hearing devices adapted for being located at or in left and right ears of a user, or adapted for being fully or partially implanted in the head of the user, each of the left and right hearing devices comprising an input unit for providing an electric input signal representing a sound in the environment of the hearing device;

a noise reduction system for estimating and reducing a noise component of the electric input signal;

antenna and transceiver circuitry allowing an interaural wireless communication link between the left and right hearing devices to be established to allow exchange of data between them, wherein the binaural hearing system is configured to, in a specific near-field mode of operation that is manually or automatically activated in a situation where a near-field sound source is present at a first one of the left and right hearing devices, transmit the estimate of the noise component, or a measure thereof, determined in a second one of the hearing devices of the binaural hearing system to the first hearing device, and use said transmitted estimate to reduce the noise component in the electric signal of the first hearing device and to provide a noise reduced signal in the first hearing device.

2. A binaural hearing system according to claim 1 wherein each of the left and right hearing devices—at least when in said specific near-field mode of operation—is configured to generate or provide a noise-reduced signal based fully or partially on one or both of the respective noise estimates from the left and right hearing devices.

3. A binaural hearing system according to claim 1 wherein at least one of the left and right hearing devices comprises an output unit for presenting a processed signal as stimuli perceived by the user as sound.

4. A binaural hearing system according to claim 1 configured to allow the user to control a mode of operation of the binaural hearing system via a user interface.

5. A binaural hearing system according to claim 4 comprising an auxiliary device configured to fully or partially implement the user interface.

6. A binaural hearing system according to claim 1 configured to provide that the specific near-field mode of operation of the binaural hearing system is automatically entered based on inputs from one or more detectors.

7. A binaural hearing system according to claim 1 configured to—when in said specific near-field mode of operation—limit the noise estimate that is determined in the second hearing device and used in the first hearing device to frequencies below a low-frequency threshold $f_{LF,th}$.

8. A binaural hearing system according to claim 1 wherein the first hearing device—when in said specific near-field mode of operation—is configured to combine the received noise estimate from the second hearing device with the noise estimate of its own noise reduction system.

9. A binaural hearing system according to claim 3 configured to present the noise-reduced signal or a signal derived therefrom in each of the left and right hearing devices via the respective output units.

10. A binaural hearing system according to claim 3 configured to provide that the electric input signal of the first hearing device—when in said specific near-field mode of operation—comprising a mixture of the near-field signal and a background noise is transmitted to the second hearing device.

11. A binaural hearing system according to claim 1 wherein each of the hearing devices comprises a multitude of input transducers, each input transducer providing an electric input signal, and the binaural hearing system being configured to exchange one or more of said electric input signals representing a sound in the environment of the respective hearing devices, or signals derived therefrom, between the left and right hearing devices.

12. A binaural hearing system according to claim 1 wherein each the left and right hearing devices comprises a hearing aid, a headset, an earphone, an ear protection device or a combination thereof.

13. A binaural hearing system according to claim 1 comprising an acoustic environment detector configured to detect whether or not a sound source is a near-field sound source relative to one of the left and right hearing devices.

14. A binaural hearing system according to claim 1 wherein the noise reduction systems of the respective hearing devices are configured to provide the estimate of the noise component as a magnitude response of the noise signal measured in different frequency channels.

15. A method for using a binaural hearing system as claimed in claim 1 with a telephone in order to improve the intelligibility of speech received via said telephone.

16. A method of operating a binaural hearing system comprising left and right hearing devices adapted for being located at or in left and right ears of a user, or adapted for being fully or partially implanted in the head of the user, the method comprising providing an electric input signal representing a sound in the environment of the hearing device;

estimating and reducing a noise component of the electric input signal;

providing an interaural wireless communication link between the left and right hearing devices to be established to allow exchange of data between them; and when in a specific near-field mode of operation that is manually or automatically activated in a situation where a near-field sound source is present at a first one of the left and right hearing devices, transmitting the estimate of the noise component, or a measure thereof, determined in a second one of the hearing devices of the binaural hearing system to the first hearing device; and using said transmitted estimate to reduce the noise component in the electric signal of the first hearing device; and providing a noise reduced signal in the first hearing device.

17. A method according to claim 16 comprising using the estimate of the noise component, or a measure thereof, from the second hearing device to improve the signal to noise ratio in the first side hearing device that is exposed to the near field sound source.

18. A data processing system comprising a processor and program code stored on a non-transitory computer readable medium which, when executed, causes the processor to perform the steps of the method of claim 16.

* * * * *